US005642759A

United States Patent [19]

Wahhoud et al.

[11] Patent Number: 5,642,759

[45] Date of Patent: Jul. 1, 1997

[54] METHOD FOR AVOIDING WEAVING A FAULTY WEFT THREAD DURING REPAIR OF WEFT THREAD FAULT

[75] Inventors: Adnan Wahhoud; Werner Birner, both of Lindau-Bodolz, Germany

[73] Assignee: Lindauer Dornier Gesellschaft mbH, Lindau, Germany

[21] Appl. No.: 661,480

[22] Filed: Jun. 10, 1996

[30] Foreign Application Priority Data

Jun. 9, 1995 [DE] Germany ..... 195 21 106.5

[51] Int. Cl.[6] ..... D03D 51/08; D03D 51/34

[52] U.S. Cl. ..... 139/116.2

[58] Field of Search ..... 139/116.2

[56] References Cited

U.S. PATENT DOCUMENTS 4,781,221 11/1988 Onishi et al. .
5,016,676 5/1991 Fourneaux et al. ..... 139/116.2

FOREIGN PATENT DOCUMENTS 0207470 1/1987 European Pat. Off. .
0309013 3/1989 European Pat. Off. .
0310804 4/1989 European Pat. Off. .
0322576 7/1989 European Pat. Off. ..... 139/116.2
0330023 8/1989 European Pat. Off. ..... 139/116.2
0332257 9/1989 European Pat. Off. ..... 139/116.2
0332258 9/1989 European Pat. Off. ..... 139/116.2
4-289245 10/1992 Japan ..... 139/116.2

*Primary Examiner*—Andy Falik
*Attorney, Agent, or Firm*—W. G. Fasse; W. F. Fasse

[57] ABSTRACT

In an air jet loom, a method is provided for avoiding weaving a faulty weft thread such as a broken weft thread into the cloth being woven. When a faulty weft thread is inserted into the loom shed, the failure of the thread to traverse the weaving width is detected preferably optoelectronically by a suitable sensor. Thereupon the weaving operation of the loom is interrupted and a repair thread is inserted into the loom shed to remove the faulty weft thread. The length of the repair thread is less than the normal length of the weft threads that are inserted for the usual weaving operation. Thereby the repair thread is too short by itself to reach the weft thread sensor, and only when the faulty thread is properly connected to the repair thread will the sensor be triggered.

13 Claims, 2 Drawing Sheets

METHOD FOR AVOIDING WEAVING A FAULTY WEFT THREAD DURING REPAIR OF WEFT THREAD FAULT

FIELD OF THE INVENTION

The invention relates to a method for avoiding weaving a faulty weft thread such as a broken weft thread into a woven cloth. Such a method uses a repair thread for pulling the faulty thread out of the loom shed.

BACKGROUND INFORMATION

Methods for providing a repair weft thread to remove a faulty weft thread are known, for example from Published European Patent Applications 0,310,804; 0,309,013; and 0,207,470; and U.S. Pat. No. 4,781,221. The disclosure of each of the just mentioned prior patent publications is incorporated herein by reference.

To carry out such known methods a weft thread sensor is provided on the weaving loom opposite the main insertion nozzle for the weft thread. After each insertion of a weft thread, this weft thread sensor monitors whether the weft thread has completely traversed the loom shed. If it has, then the weaving operation continues as usual, i.e. after forming a new shed, a next successive weft thread is inserted. On the other hand, if the inserted weft thread does not arrive at the weft thread sensor, then it is taken as an indication that a weft fault such as a broken thread has occurred and the loom control initiates an automatic process for removing the faulty weft thread. For this purpose the weaving operation is interrupted, the weaving reed is swung back into its starting position, and the weft thread cutting step is blocked or inhibited so that the inserted faulty weft thread that did not traverse the loom shed is not cut off from the weft thread supply. This method, as well as the corresponding specific steps to be taken for carrying it out, is described in more detail in U.S. Pat. No. 4,781,221 or European Patent 0,207,470.

After it has been recognized that the faulty weft thread did not reach the opposite side of the loom and the cutting operation has been interrupted, a new weft thread (known as a repair thread) is inserted onto the faulty weft thread, thereby forming a loop, for example. This loop is now carried by the relay nozzles entirely through the loom shed, i.e. across the weaving width, thereby pulling the faulty thread from the cloth fell or beat-up edge of the cloth. As soon as the inserted faulty weft thread is completely pulled off, i.e. once it has completely traversed the loom shed, it comes into contact with the sensor at the opposite end. This sensor senses and recognizes the weft thread, activates a corresponding suction device to suck the faulty thread and the repair thread from the loom shed, and activates a cutting device that cuts off the repair thread, which is then suctioned out of the loom shed together with the faulty thread. Thereafter the weaving loom returns to normal weaving operation.

If the weft thread that was inserted to repair or remove the thread breakage also gets entangled in the loom shed or suffers another fault and consequently does not arrive at the sensor, then operation of the loom does not resume, but remains stopped.

All of the known technical solutions disclosed in the above mentioned patents operate according to the method described above. A critical point for the known method is that the weft thread cutting operation must be blocked or inhibited before the inserted faulty weft thread is cut off. Otherwise, the broken or faulty weft thread cannot be automatically removed from the cloth fell or beat-up edge by inserting the repair thread as described above.

Practical experience has shown, however, that despite the triggering of a weft fault signal in response to a failure of the thread to arrive at the sensor, the cutting operation cannot always be reliably inhibited. There are many reasons for this. For example, a magnetic switch is used relatively often to interrupt the cutting operation. The response times of these magnetic switches lie typically in the range of several micro-seconds, but are subject to certain fluctuations. These fluctuations can account for up to 20% of the response time of the magnetic switches. Thus, if a faulty weft insertion coincides with an extended response time of a magnetic switch, it is altogether possible that the inserted faulty weft thread is cut despite the intended interruption or blocking of the cutting operation. Further reasons for such fluctuations in the response time include environmental influences such as temperature, humidity, fluctuations in the line voltage, vibrations, and the like. Of course, a simple mechanical error, such as a jam or breakdown or the like, can also cause such fluctuations. Additionally, various electrical fields can transmit error signals to the electrical lines of the loom control; these error signals distort or falsify the control signals and thus prevent the magnetic switch from being triggered. Similar defects can occur not only with magnetic switches, but also with other actuators that are used to interrupt the cutting operation.

Heretofore, the problem of unintended cutting of the faulty weft thread has not been recognized or addressed by those skilled in the art. According to the state of the art, a relatively long repair weft thread is inserted to remove the faulty weft thread. The length of the repair thread is greater than the length of weft thread that is typically inserted for weaving. Thus, if a faulty weft thread has been erroneously cut from the repair thread as described above, then the inserted repair thread is long enough by itself to reach the area of the weft thread sensor without having removed the faulty weft thread from the beat-up edge of the woven cloth. The sensor then recognizes the presence of the repair thread, activates the suctioning-off of this thread after it has been cut, and thereafter allows the continuation of the weaving operation. The disadvantage hereby is that the inserted faulty weft thread remains in the woven cloth and the loom is, so to speak, unaware of the error.

It is determinative for the occurrence of the above described problem that, contrary to the intended operation according to the state of the art, the faulty weft thread is cut from the repair thread that has been made ready, thereby making it impossible to automatically remove the weft fault or breakage in the classic sense. In the classic weft fault repair method, the broken or faulty weft thread must remain connected to the weft repair thread that has been made ready. Otherwise the weft fault will remain in the finished cloth as described above.

OBJECTS OF THE INVENTION

In view of the above it is the aim of the invention to achieve the following objects singly or in combination:

- to provide a method applicable to air jet looms for reliably preventing a faulty weft thread such as a broken weft thread from being woven into the cloth, even when the faulty weft thread has been unintentionally cut-off from a next succeeding repair thread:
- to provide a method whereby the loom control can reliably recognize whether a repair thread has removed or not removed a faulty weft thread from the loom shed;
- to provide a method whereby the weaving loom control can detect situations in which the faulty weft thread has been unintentionally or inadvertently cut-off from the repair thread;

to provide a method in which the weaving operation of the loom can reliably be interrupted in the event that a faulty weft thread is inadvertently cut-off from the repair thread, in order that the faulty thread and the repair thread can be removed from the loom shed; and to improve the quality of woven cloth produced by such a method, by avoiding the weaving-in of faulty weft threads into such cloth.

SUMMARY OF THE INVENTION

The above objects have been achieved in an air nozzle weaving loom by a method according to the invention wherein removal of a faulty or broken weft can be reliably ensured even when the faulty or broken weft thread has been unintentionally cut off from the repair weft thread. According to the present method, when a weft insertion fault occurs, such as the breaking of a weft thread, a weft thread sensor senses the failure of the faulty weft thread to completely traverse the loom shed due to the occurrence of the weft fault, and provides a corresponding signal to the loom control, which then causes an interruption of the weaving process. A repair weft thread is inserted into the loom shed so as to remove the faulty weft thread along with the repair thread. In order to achieve this, the sensor senses the arrival of the faulty weft thread at the downstream side of the weaving width and activates a suction device and a cutting device for removing the repair thread and the faulty thread.

According to the invention, the length of the repair thread is selected so that the repair thread by itself is too short to reach entirely across the weaving width into the area of the sensor, but the length of the repair thread plus the length of the faulty thread is sufficient to reach the sensor. Thus, if the intended interruption or blocking of the cutting process has failed, i.e. if the faulty thread is inadvertently cut-off from the repair thread, then the repair thread by itself will not reach the sensor, whereupon the sensor will provide an appropriate signal to the loom control to continue the interruption or stoppage of the weaving process. Then, further steps can be taken to remove the repair thread and the faulty weft thread from the loom shed before the weaving process resumes. For example, the cut-apart repair thread and faulty weft thread can be manually removed from the loom shed.

Contrary to the state of the art wherein the inserted repair thread has a relatively long length that is sufficient to reach across the weaving width to the sensor, it is essential according to the invention that the inserted repair thread is too short by itself to reach the sensor, and especially that it is shorter than the normal length of weft thread that is inserted for weaving.

In the method of the invention, if the cutting operation has been properly blocked or inhibited and the faulty weft thread remains connected with the repair thread, then the total length of these threads taken together is greater than the length of thread typically inserted for weaving. In this case, the total length of the threads is sufficient to reach the weft thread sensor on the opposite side of the cloth, which thus detects the arrival of the weft thread, whereupon the repair or removal of the weft thread fault is automatically completed in the above described manner. If, however, through a failure as described above, i.e. unintentionally or contrary to the intended steps of the process, the faulty weft thread is cut from the repair thread, then the inserted length of repair thread is now too short to reach the corresponding weft thread sensor. In this case, the sensor determines that the repair thread is missing, i.e. has not successfully removed the faulty weft thread, whereupon the loom control continues to maintain stoppage of the weaving operation. To remove the weft thread breakage, the faulty weft thread must be removed from the cloth manually or by other means that are not pertinent to the present invention.

A substantial advantage of the invention is that when the loom is functioning correctly, i.e. when the cutting operation is properly and successfully interrupted, the repair of a weft thread breakage is reliably achieved. If, however, the thread is cut unintentionally, then the already-cut, faulty weft thread can no longer be removed automatically from the cloth fell or beat-up edge of the cloth by the repair thread and must instead be manually removed. The present invention also handles such a failure case, because the failure is reliably recognized by the loom control and correspondingly processed by stopping the loom. Heretofore, in the state of the art, the weaving operation was resumed in such a failure case, even though the faulty weft thread was still on the beat-up edge of the cloth. This has led to defects in the woven cloth.

BRIEF DESCRIPTION OF THE DRAWINGS

In order that the invention may be clearly understood, it will now be described, by way of an example embodiment, with reference to the accompanying drawings, wherein.

Figure 1:
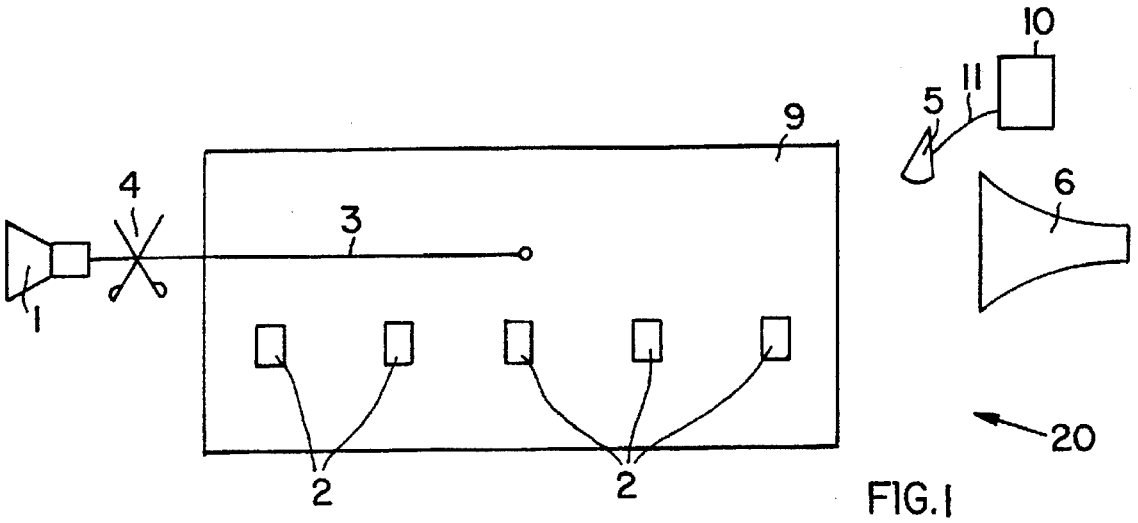
FIG. 1 schematically shows the state of a loom after a weft thread fault such as a weft thread breakage.

DETAILED DESCRIPTION OF A PREFERRED EXAMPLE EMBODIMENT AND OF THE BEST MODE OF THE INVENTION

FIGS. 1 to 4 show schematic top views of an air nozzle weaving loom 20. The loom 20 includes a main insertion nozzle 1 and several relay nozzles 2 for inserting and transporting the weft thread 3 across the entire width of the cloth. A cutting device 4 is arranged downstream from the main nozzle 1. A sensor 5 for sensing the weft thread and a suitable suction device 6 are arranged at the outlet or downstream end of the loom shed 9. The sensor 5 is preferably an optoelectronic sensor, which is known per se. A loom control 10 is connected to the sensor 5 by a signal conductor 11, so that the loom control 10 receives from the sensor 5 signals indicating the presence or absence of the weft thread 3. The loom control 10 is further connected to motors for driving the loom, which are not directly relevant to the present invention.

In the operating state shown in FIG. 1, a weft thread fault such as a weft break, tangle, or the like has occurred, since the faulty weft thread 3 has not traversed the entire width of the loom shed 9. Thus, the sensor 5 does not sense the arrival of the thread, and accordingly does not provide a weft thread arrival signal, so that the loom control 10 recognizes the existence of a weft thread fault, and then causes the above described process for removing the faulty weft thread to be carried out. Of significance in the repair process is that the cutting device 4, which normally cuts the weft thread 3 after its insertion, is deactivated.

Figure 2:
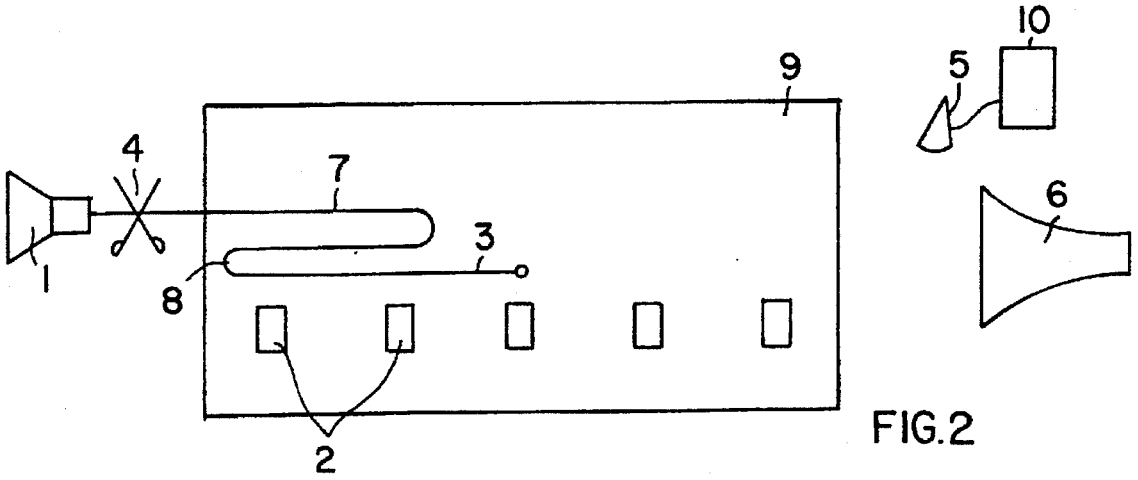
FIG. 2 shows the formation of a loop with a repair thread for removing the faulty weft thread.

A further operating state during the repair process is shown in FIG. 2. Namely, a repair thread 7 is being inserted, whereby the length of the inserted repair thread 7 is insufficient by itself to reach the sensor 5, or more particularly, is less than the weft thread length that is normally inserted for weaving. If the cutting device 4 was properly deactivated, so that a connection 8 is present between the repair thread 7 and the faulty weft thread 3, then the total length of thread is sufficient to reach the weft thread sensor 5. Thereupon the sensor 5 provides a corresponding signal to the loom control 10, which activates the suction device 6 and the cutting device 4. Thereby the repair thread 7 is cut-off from the weft thread supply, and the repair thread 7 and the faulty weft thread 3 are together suctioned off by the suction device 6.

Figure 3:
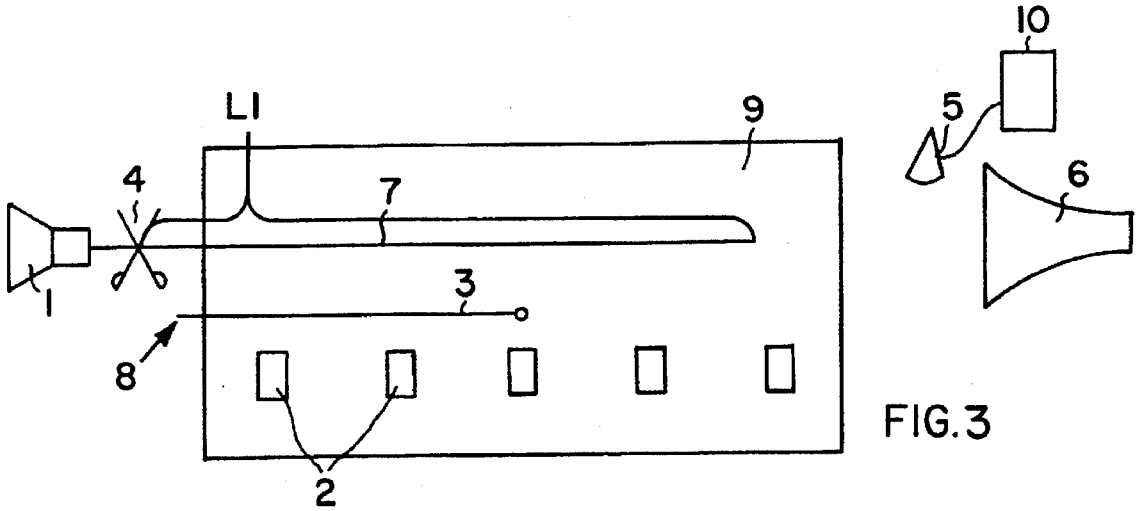
FIG. 3 shows the state of the loom following the insertion of the repair thread in an attempt to remove the faulty weft thread, which however has been unintentionally cut off from the repair thread.

FIG. 3 shows the condition when the cutting device 4 has not been properly deactivated after the faulty weft thread 3 has been inserted, so that the connection 8 has been unintentionally cut. It can be seen that the length L1 of the repair thread 7 is measured such that the repair thread 7 cannot reach and be detected by the sensor 5. The loom control 10 therefore recognizes that the weft fault has not been successfully removed, e.g. due to the absence of a repair thread arrival signal from the sensor 5 in the expected time interval. As a result, the loom control 10 delivers the appropriate signal to maintain stoppage of the loom. The faulty weft thread 3 and the repair thread 7 must then be removed manually or by other measures that are not pertinent to the present invention. Thereafter, the weaving operation is resumed, for example by manual reactivation. In this way, a fabric defect has been successfully avoided by the method of the invention.

Figure 4:
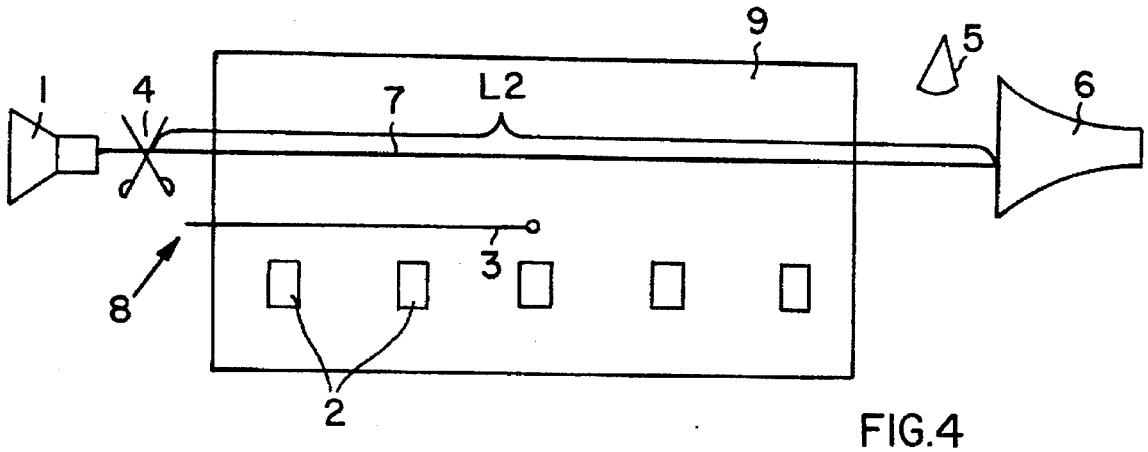
FIG.4 PRIOR ART
FIG. 4 shows a loom in a similar state as in FIG. 3, but while operating according to the prior art.

FIG. 4 shows an operating condition according to the state of the art. Here a repair thread 7 has been inserted, the length L2 of which is at least as great as the normal length of the weft threads that are typically inserted for weaving. If the connection 8 between the repair thread 7 and the faulty weft thread 3 has been unintentionally cut by the cutting device 4, then the faulty weft thread 3 will remain at the cloth fell or beat-up edge of the cloth. However, since the repair thread 7 is long enough to reach and be detected by the sensor 5, the repair thread 7 will be cut by the cutting device 4 and removed by the suction device 6. The weaving operation is subsequently resumed, whereby the faulty weft thread 3 remains woven into the cloth. This leads to a cloth defect. Just such a weaving error is successfully avoided by the method of the present invention without involving any increased cost or complexity in construction.

Although the invention has been described with reference to specific example embodiments, it will be appreciated that it is intended to cover all modifications and equivalents within the scope of the appended claims.

What we claim is:

1. A method for avoiding weaving a faulty weft thread, which has been inserted into a loom shed of an air jet loom, into a cloth being produced on said loom, wherein said loom has a weft insertion nozzle and a thread cutting device at an insertion side of said loom shed and a weft thread arrival sensor at a downstream side of said loom shed opposite said insertion side, and wherein said method comprises the following steps:

(a) sensing with said sensor a failure of said faulty weft thread to arrive at said sensor;

(b) interrupting a weaving operation of said loom upon sensing said failure; and (c) inserting into said loom shed a repair thread for removing said faulty weft thread, wherein said repair thread has a length insufficient to reach said sensor.

2. The method of claim 1, further comprising maintaining a connection between said faulty weft thread and said repair thread, wherein a combined total length of said faulty weft thread and said repair thread together is sufficient to reach said sensor, and further comprising sensing with said sensor an arrival of said faulty weft thread at said sensor, and removing said faulty weft thread and said repair thread together from said downstream side of said loom shed.

3. The method of claim 2, wherein said loom further includes a weft thread removal device at said downstream side of said loom shed, and wherein said step of removing said faulty weft thread and said repair thread is triggered by said faulty weft thread being sensed by said sensor and is carried out by activating said weft thread removal device and said thread cutting device.

4. The method of claim 3, further comprising automatically resuming said weaving operation of said loom upon completion of said step of removing said faulty weft thread and said repair thread.

5. The method of claim 1, further comprising cutting-off said faulty weft thread from said repair thread with said cutting device, wherein said repair thread by itself does not reach said sensor, and further comprising sensing with said sensor a failure of at least one of said repair thread and said faulty weft thread to arrive at said sensor, and maintaining said interrupting of said weaving operation.

6. The method of claim 5, further comprising removing said repair thread and said faulty weft thread from said loom shed during said step of maintaining said interrupting of said weaving operation, and then resuming said weaving operation of said loom.

7. The method of claim 6, wherein said step of removing said repair thread and said faulty weft thread is carried out manually, and said resuming of said weaving operation is activated manually.

8. The method of claim 5, wherein said step of cutting-off said faulty weft thread from said repair thread occurs through an unintended faulty operation of said cutting device.

9. The method of claim 5, wherein said step of interrupting a weaving operation of said loom includes providing a control signal for deactivating said cutting device.

10. The method of claim 1, further comprising a preliminary step of inserting a normal weft thread having a normal length into said loom shed in a weaving operation, wherein said length of said repair thread is less than said normal length of said normal weft thread.

11. The method of claim 1, wherein said length of said repair thread is less than a weaving width of said loom shed.

12. The method of claim 1, wherein said loom further has a loom control connected to said sensor, wherein said interrupting of said weaving operation is triggered and controlled by said loom control upon receiving a signal from said sensor indicating said failure of said faulty weft thread to arrive at said sensor.

13. A method of determining whether a faulty weft thread has been successfully removed from a loom shed of an air jet loom, comprising the following steps:

a) inserting into said loom shed a repair thread for removing said faulty weft thread, wherein said repair thread by itself has a length insufficient to reach entirely across said loom shed and to a weft thread sensor arranged at a downstream side of said loom shed;

b) sensing with said sensor whether a thread arrives at said sensor within a certain time interval after beginning said step a) and correspondingly triggering one of a thread arrival signal and a thread fault signal; and c) performing one step selected from removing said faulty weft thread and said repair thread from said loom shed upon said triggering of said thread arrival signal, and maintaining a loom stop condition and triggering a fault alarm upon said triggering of said thread fault signal.

* * * * *